US009089722B2

(12) United States Patent
Skov et al.

(10) Patent No.: US 9,089,722 B2
(45) Date of Patent: Jul. 28, 2015

(54) FILTER CARTRIDGE, FILTERING FACE MASK AND METHOD FOR MANUFACTURING

(71) Applicants: Torben Skov, Pliezhausen (DE); Roman Skov, Stuttgart (DE); Frank Kern, Pliezhausen (DE)

(72) Inventors: Torben Skov, Pliezhausen (DE); Roman Skov, Stuttgart (DE); Frank Kern, Pliezhausen (DE)

(73) Assignee: Moldex-Metric, Inc., Culver City, CA (US)

( * ) Notice: Subject to any disclaimer, the term of this patent is extended or adjusted under 35 U.S.C. 154(b) by 0 days.

(21) Appl. No.: 13/815,270

(22) Filed: Feb. 14, 2013

(65) Prior Publication Data

US 2014/0224256 A1 Aug. 14, 2014

(51) Int. Cl.

| | |
|---|---|
| ***B01D 46/00*** | (2006.01) |
| ***A62B 18/02*** | (2006.01) |
| ***A62B 23/02*** | (2006.01) |

(52) U.S. Cl.

CPC ..... *A62B 18/02* (2013.01); *A62B 18/025* (2013.01); *A62B 23/02* (2013.01); *Y10T 29/49908* (2015.01)

(58) Field of Classification Search

CPC ..... B01D 46/10; B01D 46/521; B01D 46/05; B01D 46/24; B01D 46/87; B01D 46/4272

USPC ..... 55/490–495, 310, 385.3, 498; 210/234, 210/446

See application file for complete search history.

(56) References Cited

U.S. PATENT DOCUMENTS

| | | | | |
|---|---|---|---|---|
| 2004/0083692 | A1* | 5/2004 | Dworatzek et al. | 55/310 |
| 2011/0215043 | A1* | 9/2011 | Trottier et al. | 210/234 |
| 2012/0157904 | A1* | 6/2012 | Stein | 602/43 |

FOREIGN PATENT DOCUMENTS

WO WO2009145992 * 12/2014

* cited by examiner

*Primary Examiner* — Jason M Greene
*Assistant Examiner* — Karla Hawkins
(74) *Attorney, Agent, or Firm* — Charles H. Schwartz

(57) ABSTRACT

The invention relates to a filter cartridge for an air filtering device, in particular for a filtering face mask and a method for manufacturing a filter cartridge, comprising a stiff cup-shaped casing having a bottom and a circumferential sidewall extending at least section-wise parallel to one axis, a stiff discoidal lid and a filter bed of loose filter material compressed between the lid and the casing, the lid and the bottom containing each at least one through-hole so that air to be filtered passes through the filter bed, and at least one of the lid and the bottom being curved to at least one direction, whereby the lid is at least essentially arranged within the casing, the outermost contour of the lid close-fitting to the inner contour of the sidewall, and fixed thereto by a direct connection, particularly by a non-detachable connection.

15 Claims, 5 Drawing Sheets

FILTER CARTRIDGE, FILTERING FACE MASK AND METHOD FOR MANUFACTURING

The present invention relates to a filter cartridge for an air filtering device, in particular for a filtering face mask, comprising a cup-shaped casing having a bottom and a circumferential sidewall, a discoidal lid and a filter bed of loose filter material compressed between the lid and the casing, the lid and the bottom each containing at least one through-hole so that air to be filtered passes through the filter bed.

The present invention further relates to a filtering face mask that comprises a mask body adapted to fit over the nose and mouth of a person and at least one filter cartridge that is arranged in an orifice of the mask body.

The present invention also relates to a method for manufacturing a filter cartridge for air filtering devices.

BACKGROUND OF THE INVENTION

Filter cartridges for air filtering devices are usually used as filter elements of a filtering face mask that comprises a mask body adapted to fit over the nose and mouth of a person such that the air the person breathes passes through the filter cartridge and is cleared from harmful components such as fine dust, dust or other components. For comfort and design reasons it is desirable to obtain a filter cartridge having the shape adapted to the general shape of a person's face. In particular, it is desirable to have a cartridge that is curved to at least one direction. While manufacturing a housing of a curved cartridge is not a problem, providing a curved filter bed is, since conventional storm filling techniques are not sufficient for a curved filter bed.

Corresponding attempts have been made for example in the European patent specification EP 0 309 277 B1 where a method of manufacturing a filtering device involves the use of an injection mold that is adapted to receive a resilient, porous, substantially rigid filtration element and resin injected into the mold at a certain pressure to form a solid, molded filtering device that may have a curved shape. The mold process as such, however, is cost-intensive and time-consuming.

The international publication WO 2009/145992 A1 discloses another air filtering device having a curved filter bed of a loose filter material. The filter material is held by a cartridge that comprises a cup-shaped casing and a discoidal lid. During manufacturing the filter material is deposited on the flat horizontally oriented support plate in particular by storm filling. Afterwards, the support plates are deformed to obtain a filter bed having at least one curvature. This requires the casing or the lid to be flexible in nature and some kind of support structure that keeps the cartridge of the filter bed in its curved shape.

OBJECT OF THE INVENTION

It is an object of the present invention to design a filter cartridge and a filtering face mask which are easy and cost-effective in construction, the filter cartridge being self-retaining such that its curved shape is kept by itself, as well as a method for manufacturing such a filter cartridge.

SUMMARY OF THE INVENTION

The inventive filter cartridge is characterized by the features of the claims. It has the advantage that while loose filter material and a conventional filling method, not necessarily storm filling, can be used, a curved-shape of the filter bed is obtained and kept without the need of a further supporting structure. In the context of the present invention loose filter material is preferably to be regarded as loose particles or granulate.

The inventive filter cartridge comprises a stiff cup-shaped casing having a bottom and a circumferential sidewall extending at least section-wise parallel to one axis, a stiff discoidal lid and a filter bed of loose filter material compressed between the lid and the casing, the lid and the bottom each containing at least one through-hole so that air to be filtered passes through the filter bed, and at least one of the lid and the bottom being curved to at least one direction, whereby the lid is at least essentially arranged within the casing, the outermost contour of the lid close-fitting to the inner contour of the sidewall, and fixed thereto by a direct connection, particularly by a non-detachable connection. This configuration of the casing and the lid allows the filter material to be compressed directly by the lid and the casing. Due to the compression of the loose filter material by the lid and the casing the material is distributed evenly throughout the filter bed chamber provided between the lid and the casing such that a uniform filter bed is obtained. By arranging the lid within the casing, the lid having its outermost contour close-fitting to the sidewall of the casing, the lid can be pushed into the casing until the filter material is compressed to a desired amount, in particular such that it is distributed evenly, whereby the close-fit seals off the filter bed chamber. By fixing the lid to the casing directly or by using a direct connection a stand-alone solution for a filter cartridge is provided that does not require any additional parts to keep the loose filter material compressed in the casing. In the context of the invention a direct connection is therefore understood to be a connection that acts directly between the lid and the casing. By using a non-detachable connection, the lid is permanently fixed to the casing and the filter cartridge is permanently and safely closed. A non-detachable connection, also called permanent connection, is characterized in that it cannot be undone without destroying it. The non-detachable connection keeps the filter cartridge safely closed and misuse is prohibited. All in all the inventive filter cartridge has the advantage that it is designed as a self-contained module that can be used in a wide range of different filtering devices which can be handled safely, even if detached from the filtering devices.

According to a preferred embodiment the lid is fixed to the casing by form closure or material connection. While the form closure offers a reliable fixation of the lid to the casing at any time the material connection features less requirements for the design of the lid and the casing. The material connection can be established in a time and cost saving way between any lid and casing that feature a close fit as described above.

The term form closure is well known in the art and describes a mechanism that prevents the motion of a rigid body partially or completely by contact with fixed surfaces without reference to applied forces. The term material connection relates to a different kind of mechanism between two elements, whereby the two elements are partially changed or influenced such that the elements are hold together by atomic or molecular forces such the materials of the two elements are merged. A material connection can be established directly between the two elements of the cartridge or by providing a merging material such as glue, soldering agent or the like between the two elements.

According to a preferred embodiment only a form closure or a material connection is provided. However, according to another preferred embodiment both fixation methods, i.e. a form closure as well as a material connection, are provided complimentary.

Preferably, the material connection or adhesive bond that particularly extends along the whole circumference of the lid is a weld connection. In particular, if as described above, the lid and the casing are made of a plastic material, the weld connection can be established time- and cost-effective. The material connection, in particular the weld connection preferably extends along the whole circumference of the lid so that the chamber holding the compressed filter material is sealed off such that the filter material is safely hindered from leaving said chamber. According to an alternative embodiment of the invention the material connection is provided as discrete connection points distributed along the circumference of the lid. In this respect the material connection is preferably provided as a welding seam or as a number of welding spots. By fixing the lid to the casing by a material closing that extends at least along one circumferential area, either continuously or as discrete spots, the lid is safely secured in its position in which the filter material is compressed to the desired state. Since the lid and the casing are stiff, the curved shape is kept and a self-retaining cartridge with a curved filter bed is obtained. According to a further embodiment of the invention instead of providing a weld connection an adhesive is provided between the lid and the casing extending at least along one circumferential area, either continuously or as discrete spots, as described with respect to the weld connection above.

Preferably, the form closure comprises at least one plastically deformed portion of at least one of the casing and the lid. By plastically deforming the lid or the casing for establishing the form closure the lid can be inserted into the casing easily to compress the loose filter material before the respective portion of the lid or the casing is plastically deformed. By providing a plastically deformed portion of the casing or the lid the fixation of the lid to the casing can be established in a cost effective way. Particular, the need for a further fixation agent such as glue is unnecessary.

According to a preferred embodiment of the invention at least one plastically deformed portion of the lid is deformed such that it protrudes to the inside of the casing acting upon the lid to maintain the loose filter material compressed between the lid and the casing. According to this embodiment the portion of the casing is deformed plastically after the lid has been inserted into the casing to compress the filter material. The portion is deformed such that it acts upon the lid forcing it against the loose filter material to keep it compressed. It is particular preferred that a number of plastically deformed portions of the casing are provided along its circumference, preferably evenly distributed along the circumference of the side wall of the casing, to provide an evenly force acting upon the lid such that the loose filter material is compressed uniformly.

According to a further embodiment of the invention the plastically deformed portion is a plastically deformed portion of the inner surface of the side wall of the casing. The inner surface of the side wall is preferably deformed by using a tool that is essentially moved parallel to the side wall in the axial direction towards the lid or the bottom of the casing such that material of the side wall is pushed and compressed downwards in the direction of the lid or the bottom, thereby creating a protrusion that reaches inwards. Alternatively, the tool can be essentially moved perpendicular towards the outer side of the sidewall, deforming the sidewall such that material is pushed into the chamber, thereby creating said protrusion. Before or during the deformation process the tool and/or the casing are preferably heated up.

According to an alternative embodiment of the invention the plastically deformed portion is a bend projection that protrudes from a free end of the side wall. According to this embodiment the casing is provided with at least one projection that preferably protrudes from the free end face of the side wall as prolongation of the side wall, i.e. following the direction of the side wall. Once the lid is inserted into the casing the projection is bend inwardly such that it is plastically deformed to act upon the lid in the above described manner. Preferably the casing is heated up before or during the bending process.

Deforming a portion of the inner surface of the side wall has the advantage that the deformed portion can be provided at any desired place on the inner surface such that adapting the fixed (axial) position of the lid within the casing is simplified. Providing a protrusion to be bent on the side wall simplifies the deforming process. According to a further embodiment, both mechanisms for providing the formed closure can be used for the same cartridge complimentary. Preferably the cartridge is provided with a number of deformed portions evenly distributed around its circumference.

According to a preferred embodiment of the invention the lid is designed such that it contains a circumferential protrusion that protrudes essentially parallel to said axis in at least one direction. The lid therefore comprises a circumferential edge constituting the outer contour of the lid and providing a contact surface facing the inside of the side wall of the casing having a height greater than that of the lid itself. Herewith a large contact area is provided that allows for a safe attachment of the lid to the side wall in particular by said material closure. The protrusion or edge may be pointing to the bottom of the casing or into the opposite direction. According to a particularly preferred embodiment the edge protrudes in both directions parallel to the axis or the side wall of the casing.

Preferably, the lid extends parallel to the bottom such that the distance between the lid and the bottom is constant and that the filter bed has a uniform height. In this case both the lid and the bottom of the casing are curved to at least one direction, whereby the curvature of the bottom and the curvature of the lid extend parallel to one another, preferably such that the curvatures extend along different radii having the same reference point. In this way it is ensured that the air to be filtered flows uniformly through the filter bed since it encounters the same flow resistance across the filter bed. Of course it is also possible to design the cartridge such that a certain flow resistance characteristic across the filter bed differing from the uniform characteristic is obtained.

According to a preferred embodiment the bottom is curved such that it is formed essentially concave, i.e. that the bottom is formed such that it reaches into the casing. This helps during the pressing step to evenly distribute the loose filter particles, in particular when the filter material is initially deposited in the area of the highest point of the bottom.

In order to support the uniformly flow rate through the filter bed the lid and the bottom preferably each contain a plurality of evenly distributed through-holes. It is particularly advantageous if the through-holes of the lid and the through-holes of the bottom are aligned to one another to lower the flow resistance through the filter cartridge. However, a misaligned arrangement is preferred according to an alternative embodiment of the invention.

According to a further embodiment of the invention the surfaces of the lid and the bottom facing each other are each covered by a fleece element extending across the at least one respective throughhole. The fleece element is configured such that it retains the loose particles/granulate of the filter material within the cartridge if the 15 through-holes of the lid and the bottom have a diameter larger than the particles of the filter material. The fleece element is thus preferably designed as fleece layer that covers the respective surface entirely. During manufacturing of such cartridge first the fleece element is arranged on the bottom inside the casing, then the loose filter material particles are deposited on the fleece element and afterwards the lid with the respective fleece element is pushed into the casing, compressing the loose filter material to the desired filter bed.

According to another embodiment of the present invention the casing comprises at least one holding element, in particular configured to be connected to a holding strap of a filtering face mask. The holding element is preferably designed in one piece with the case of the cartridge. The filtering face mask itself is then attached to the holding strap through the cartridge held by the filtering face mask. Usually, filtering face masks comprise a mask body which is flexible in nature so that the mask body can be adapted comfortably to the face of a person. Providing the holding element on the stiff cartridge instead of on the mask body therefore allows for a secure connection of the holding strap to the filtering face mask. The holding force is then transmitted through the cartridge onto the mask body.

It is preferred that the holding element is designed as clamping arrangement having a clamping projection that protrudes radially outward from the sidewall of the casing and onto which a clamping ring can be or is slid for fastening the holding strap thereto. The clamping arrangement with the protrusion and the ring offers an easy to use and cost-effective solution for fastening a holding strap to the cartridge or the filtering face mask. The casing and the lid are preferably made of plastic material whereby the clamping projection is preferably designed in one piece with the casing.

The inventive filtering face mask is characterized by the features of claim. It comprises a mask body adapted to fit over the nose and mouth of a person and at least one filter cartridge that is arranged in an orifice of the mask body, whereby the filter cartridge is designed according to the above described embodiments.

The mask body preferably comprises an orifice designed as receptacle in which the cartridge is held with its outer contour of the side wall in a sealed manner such that air to be filtered passes through the filter bed of the filter cartridge. Preferably, the receptacle has at least one abutting shoulder for aligning and supporting the cartridge in the opening of the mask body. Particular preferably, the receptacle is designed such that the cartridge is replaceable. For that the receptacle is preferably at least partially flexible. According to a preferred embodiment of the invention the receptacle is formed in one piece with the mask body of the filtering face mask which is elastically deformable.

According to a particular embodiment of the invention a cup-shaped support element having at least one opening is provided between the abutting shoulder of the receptacle and the cartridge. The support element is preferably designed such that it is essentially spaced apart to the cartridge bottom while having an outer contour corresponding to that of the cartridge. The spaced apart arrangement of the support element is such that the bottom of the cartridge is supported while at the same time one or more air ducts are provided between the cartridge and the support element or the mask body, respectively. The support element therefore ensures that an air connection between the person wearing the filtering face mask and the cartridge is provided at all times. According to a further embodiment of the invention a valve element is assigned to the opening of the support element constituting a valve, in particular an inhalation valve.

Preferably, the cartridge is held in the receptacle by a form-closure between the casing and the mask body such that the position of the lid within the casing is not relevant for the arrangement of the casing in the receptacle. In this way cartridges with different amounts of compressed filter material can be held by the same receptacle.

According to a preferred further embodiment of the invention the mask body comprises at least one through-hole extending from the opening or receptacle to the outside of the mask body whereby the clamping protrusion of the cartridge projects therethrough so that the holding strap of the face mask may be fastened to the clamping protrusion outside the mask body by the clamping ring. The receptacle preferably covers the whole outer surface of the side wall of the casing except for the clamping protrusion which projects through the through-hole of the mask body.

The inventive method for manufacturing a filter cartridge for air filtering devices, in particular for a filtering face mask, comprises the steps described in claim 13: First a stiff cup-shaped casing having a bottom with at least one through-hole and a circumferential sidewall extending at least section-wise parallel to one axis is provided. Then a desired amount of loose filter material is poured or deposited into the casing onto its bottom. Afterwards, a stiff lid with its outermost contour close-fitting to the inside of the sidewall of the casing and having at least one through-hole is provided, whereby the lid and/or the bottom are curved into at least one direction. The lid is pressed at least essentially into the casing until the filter material is compressed to a uniform filter bed where the filter material is evenly distributed across the cartridge. Once the lid has reached its final position, i.e. the loose filter material is in the desired compressed state, the lid is fastened to the side wall by manufacturing or providing a direct connection, in particular a non-detachable connection, between the lid and the casing, so that the loose filter material is kept in its compressed state.

Preferably, before pouring the filter material into the casing, the bottom of the casing is covered by a fleece element, as described above. Similarly, before pressing the lid into the casing, the lid is provided with another fleece element on its surface facing the bottom of the casing.

According to a preferred embodiment of the invention the nondetachable connection is designed as material connection between the lid and the casing. According to a preferred embodiment of the invention the non-detachable or material connection is manufactured by welding or gluing the lid and the sidewall together. The lid and the casing are preferably made of a plastic material such that the welding procedure can be conducted cost- and time-effective. Preferably, the welding connection is established by pushing a warm or hot needle into the slid between lid and the casing, thereby deforming and heating both elements, whereby the needle is so hot that the material of the lid and the casing reaches its respective melting point, so that the material connection or welding connection between the lid and the casing is created by a merging process. Preferably the needle is pushed only partially into the slid such that once the needle is removed no through-hole remains.

According to an alternative embodiment of the invention the nondetachable connection providing by plastically deforming a portion of at least one of the casing and the lid as described above. For providing a deformed portion it is preferred that either the inside of the side wall is deformed using a tool that is essentially moved parallel to the side wall, pushing the material of the side wall such the protrudes inward, or by bending the protrusion extending from the side wall, preferably from the free end side of the side wall inwards. Both methods have already been described above in great detail.

The final position of the lid within the casing depends on the amount of the filter material provided in the cartridge. The free end of the sidewall of the casing or—in other words—the remaining side wall of the casing which is not used for containing the filter material can be cut off to lower the overall height of the cartridge. According to a preferred embodiment, however, the remaining sidewall is kept such that the filter cartridge has the same overall height regardless of the amount of filter material used and the respective filtering ratio obtained.

The invention will now be more particularly described, by way of example, with reference to the accompanying schematic drawings, in which.

Figure 1:
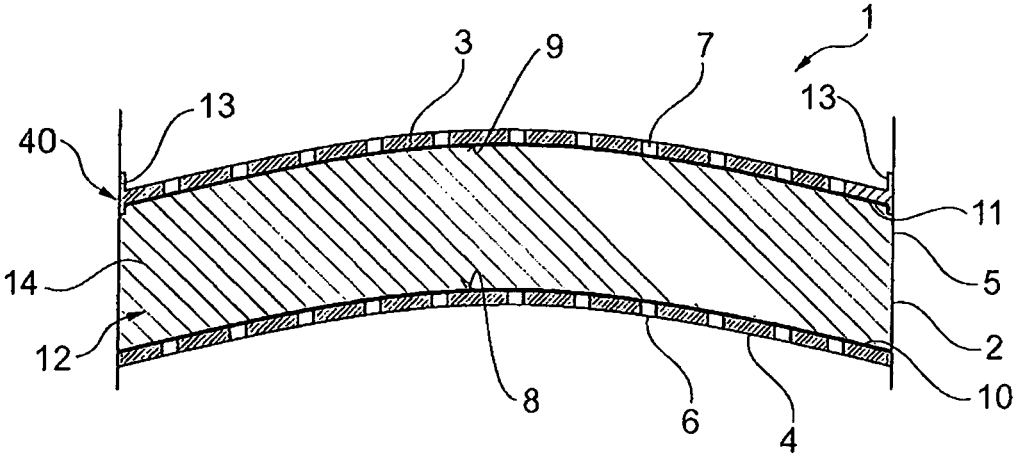
FIG. 1 is a schematic sectional view of a filter cartridge.

FIG. 1 shows a sectional schematic view of a self retaining filter cartridge 1 for an air filtering device. The filter cartridge 1 comprises a cup-shaped casing 2 and a discoidal lid 3. The casing 2 and the lid 3 are both made of a plastic material such that they are essentially stiff. The casing 2 comprises a bottom 4 from which a circumferential side wall 5 extends parallel to an axis such that opposing sections of the side wall 5 are aligned parallel to one another as shown in FIG. 10. The lid 3 and the bottom 4 are both curved to one direction whereby the curvature of the lid 3 corresponds to the curvature of the bottom 4 such that the lid extends at least essentially parallel to the bottom and the distance between the lid 3 and the bottom 4 is constant across the cartridge 1. According to a preferred 15 embodiment the bottom 4 and the lid 3 extend along different radii having the same point of origin or centre point. Both the lid 3 and the bottom 4 are provided with a plurality of evenly distributed throughholes 6, 7 that allow air to be filtered to pass through the filter cartridge 1.

Surfaces 8 and 9 of the lid 3 and the bottom 4, respectively, that face each other are both covered by a fleece element 10, 11. The respective fleece element 10, 11 extends across the surface 8 or 9 such that each of the respective through-holes is covered by the respective fleece element 10 or 11.

The outer contour of the lid 3 corresponds to the (inner) contour of the sidewall 2 such that between the lid 3 and the casing 4 a closed chamber 12 with a constant height is provided. In this chamber 12 a desired amount of filter material in the form of a powder or granulate is provided, compressed between the bottom 4 and the lid 3 to form a curved filter bed 14. During manufacturing of the filter cartridge 1 first the filter material is deposited on the bottom 4 covered by the fleece element 10, then the lid 3 with the fleece element 11 is pushed into the casing 2 in the axial direction until the filter material is compressed to a certain amount. Afterwards, the lid 3 is attached/fastened to the side wall 5 of the casing 2 by a material connection 40, preferably in the form of a weld connection that ( . . . extends as welding seam or as a number of in particular evenly distributed welding spots along the circumference of the lid 3 on its outer contour. To increase the tightness and stability of the connection between the lid 3 and the casing 2, the lid 3 contains a circumferential protrusion 13 that protrudes essentially parallel to the before-mentioned axis. According to the present embodiment the protrusion 13 extends into both directions, i.e. pointing towards the bottom 4 and pointing away from the bottom 4 such that the outer contour of the lid 3 is T-shaped. According to another embodiment not shown in the drawings the protrusion 13 only protrudes into one direction, i.e. pointing towards the bottom 4 or pointing away from it. In either case the protrusion 13 provides a large contact surface close-fitting to the inside of the sidewall or touch-contacting the inside of the sidewall preferably along the whole circumference of the lid 3, constituting the outer contour of the lid 3. The large surface is advantageous for the welding process and for the tightness of the closing.

Depending on the desired filtration ratio of the filter cartridge 1 a desired amount of the filter material is poured into the casing 2. Depending on the amount deposited in the casing 2 the lid 3 is pushed into the casing 2 accordingly far. The free end of the sidewall i.e. the section of the sidewall 5 on the other side of the filter material is kept according to the present example, regardless of the amount of filter material used. In that way the filter cartridge 1 has the same height even if different filtering ratios can be provided. That makes it easier to use the filter cartridge as replaceable filter cartridge in a face filtering mask as shown in the next Figure.

Figure 2:
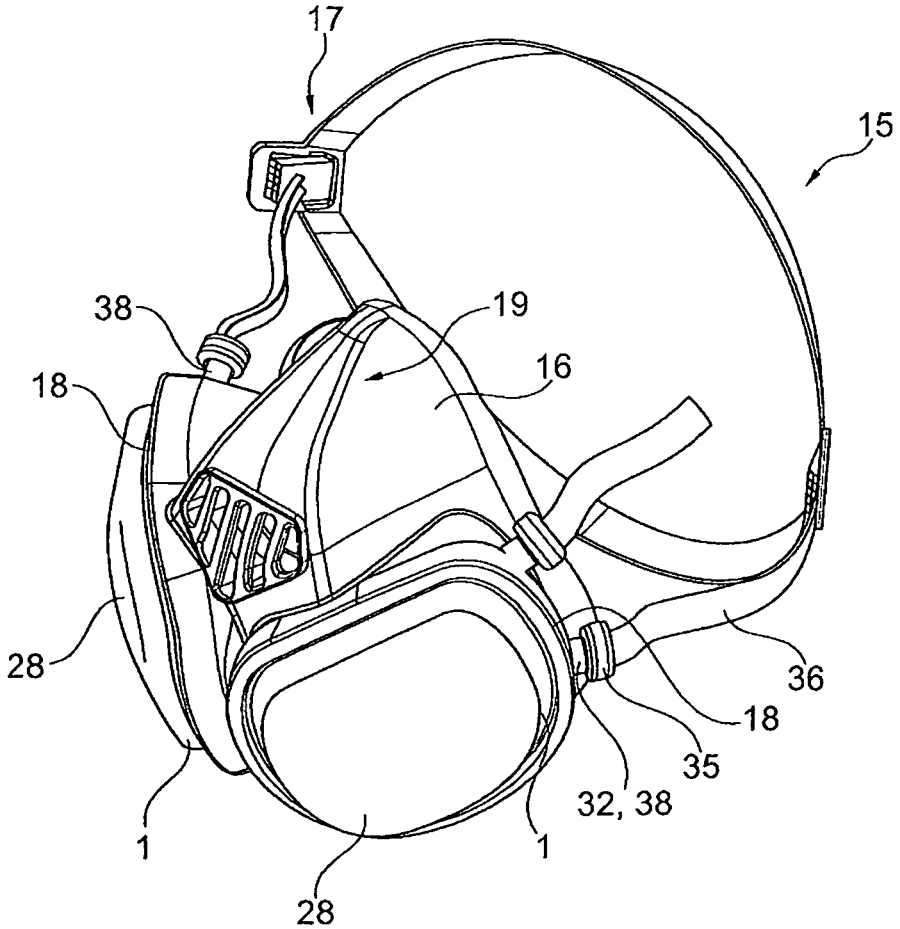
FIG. 2 is a perspective view of a filtering face mask equipped with two of the filter cartridges of FIG. 1.

FIG. 2 is a perspective view of an air filtering device designed as filtering face mask 15 that comprises a mask body 16 adapted to fit over the nose and mouth of a person, two of the filter cartridges 1 and a holding strap arrangement 17 attached to the mask body and adapted to encompass the head of a person in order to fasten the mask body 16 to the person's face.

The mask body 16 comprises two receptacles 18 in which the cartridges 1 are held. The mask body 16 further comprises a nose 15 section 19 in which an exhalation-valve is provided.

Figure 3:
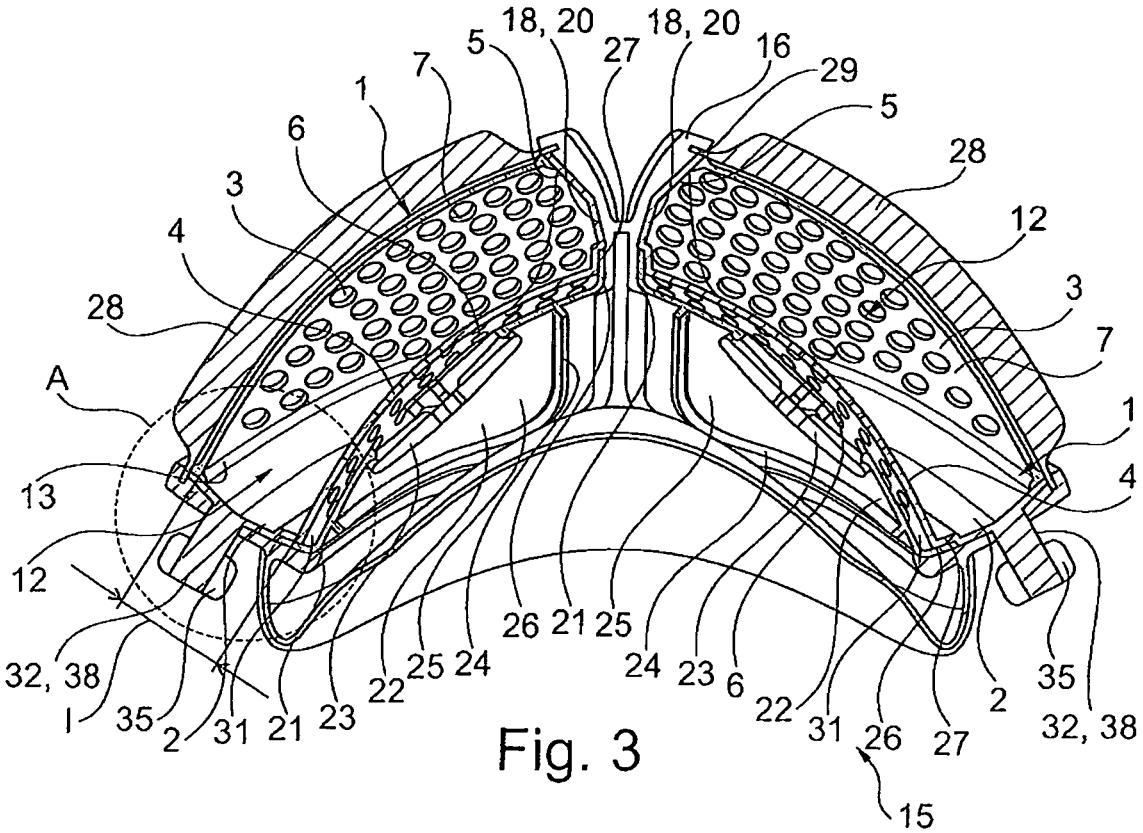
FIG. 3 is a sectional view of the face mask according to a first embodiment.

FIG. 3 is a sectional view of the filtering face mask 15 according to a first embodiment through both filter cartridges 1 below the nose (piece 19. The receptacles 18 of the mask body 16 are configured as orifices 20 that reach through the mask body 16. The sidewalls of the orifices 20 are configured such that they accommodate the respective casing 2, in particular the respective sidewall 5 of the respective filter cartridge 1. In contrast to the schematic embodiment of FIG. 1 the sidewalls 5 of the filter cartridges 1 are not entirely parallel to one axis. Only the upper section—as seen from the bottom 4—extends parallel to a respective axis such that only the upper section of the sidewall 2 allows the lid 3 to be positioned freely. The lower section of the sidewall 5 is essentially V-shaped. According to the embodiment of FIG. 3 the lid 3 is arranged at the maximum distance to the bottom 4 such that the highest amount of filter material is provided in the respective filter cartridge 1 (filter material not shown). The respective receptacle 18 provides an abutting shoulder 21 on the inside of the orifice 20 with respect to the person wearing the face mask 15. On the abutting shoulder 21 that extends across the circumference of the opening and protrudes radially inward a cup-shaped support element 22 is arranged. The support element 22 contains an opening 23 in its bottom 25 and a supporting rib 24 protruding from the bottom 25 into the direction of 10 the person wearing the filtering face mask 15.

The free end of a sidewall 26 of the support element 22 points towards the filter cartridge 1. The casing 2 of the filter cartridge 1 contains on the lower section of the sidewall 5 a recess 27 in which the free end of the circumferential sidewall 26 is accommodated, as can be seen best in FIG. 4 which is a detailed view of the area A from FIG. 3.

The height of the sidewall 26 is greater than that of the recess 27 such that the bottom 25 of the support element 22 is essentially spaced apart from the bottom 4 of the casing 2 constituting an air duct 31 leading to the opening 23. For manufacturing the filtering face mask 15 first the support elements 22 are pushed into the orifices 20 or receptacles 18 onto the abutting shoulder 21, then the respective filter cartridge 1 is pushed into the opening until it rests on the support element or the sidewall 26 of the support element 22, 25 respectively.

As an alternative manufacturing procedure the respective filter cartridge 1 and support element 25 can be pre-assembled and subsequently both can be enclosed by the mask body 16 during a molding process in which the mask body 16 is manufactured.

On top of the lid 3 a filter pad 28 is arranged that extends across the filter cartridge 1 such that it reaches over the sidewall 5 of the respective casing 2 and into a recess 29 of the mask body 16 with a circumferential holding edge 30. The filter pad 28 can be arranged in the already fabricated mask body 16 or it can be over-molded during the molding process of the mask body 16 together with the filter cartridge 1 and the support element 22.

During use of the filtering face mask the filter pad 28 acts as pre-filter before the air to be filtered passes through the filter material 14 within the cartridge. Finally, the filtered air passes through the air duct 31 and through the opening 23 to the person's mouth or nose. The exhalation air of the person wearing the filtering face mask 15 is 15 guided through the exhalation-valve of the nose section 19.

From the sidewall 5 of the respective casing 2 a clamping projection 32 protrudes radially outward through a through-hole 33 of the mask body 16 such that the free end 34 of the clamping projection 23 is arranged outside of the filtering face mask 15. On the free end 34 a clamping ring 35 is slid such that a holding strap 36 of the holding strap arrangement 17 is clamped between the clamping ring 35 and the clamping protrusion 32. Preferably, the clamping protrusion 32 contains a plurality of circumferential recesses 37, in particular in the form of latching depressions for increasing the strength of the clamping arrangement. The clamping protrusion 32 constitutes a holding element 38 for the holding strap arrangement 17. Of course, also other kinds of holding elements could be provided. As can be seen from FIG. 2, each filtering cartridge 1 contains at least two of 19 the holding elements 38 on one side of the respective filter cartridge 1 such that two holding straps 36 can be connected to each filter cartridge 1.

Figure 5:
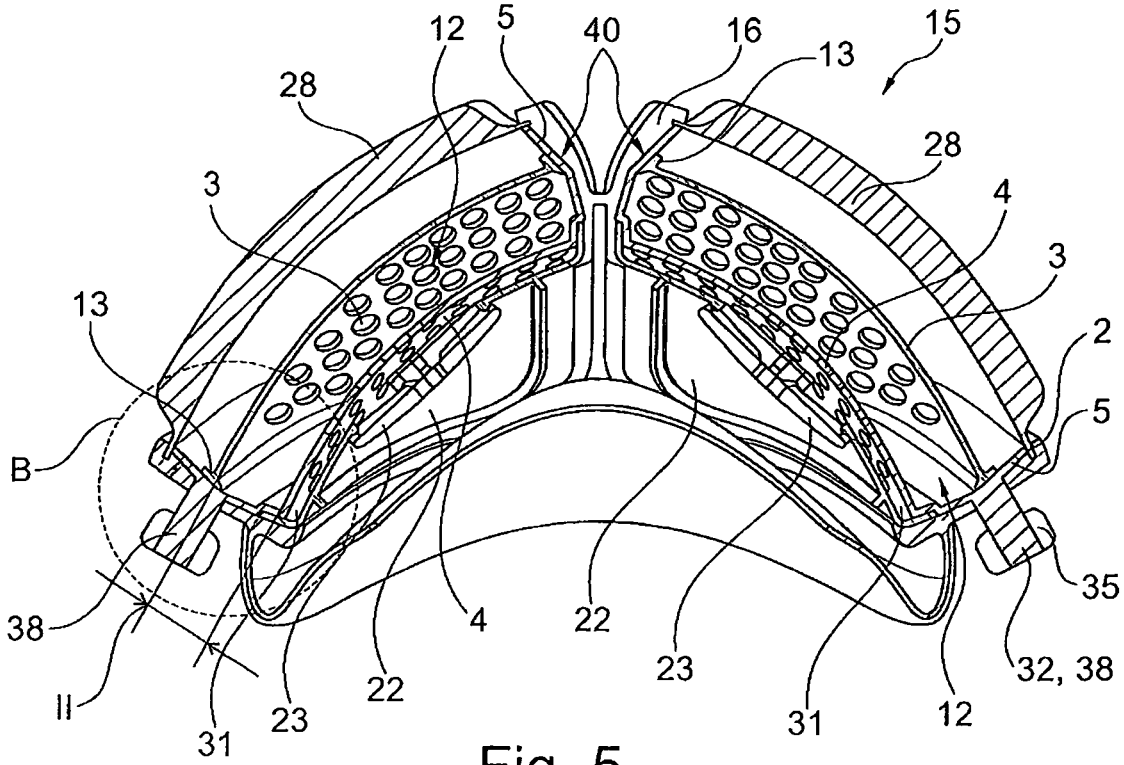
FIG. 5 is a sectional view of the face mask according to a second embodiment.

FIG. 5 is a sectional view through the filtering face mask 15 5 according to a second embodiment. Previously described elements are provided with the same reference signs and in the following it shall only be referred to differences.

Figure 4:
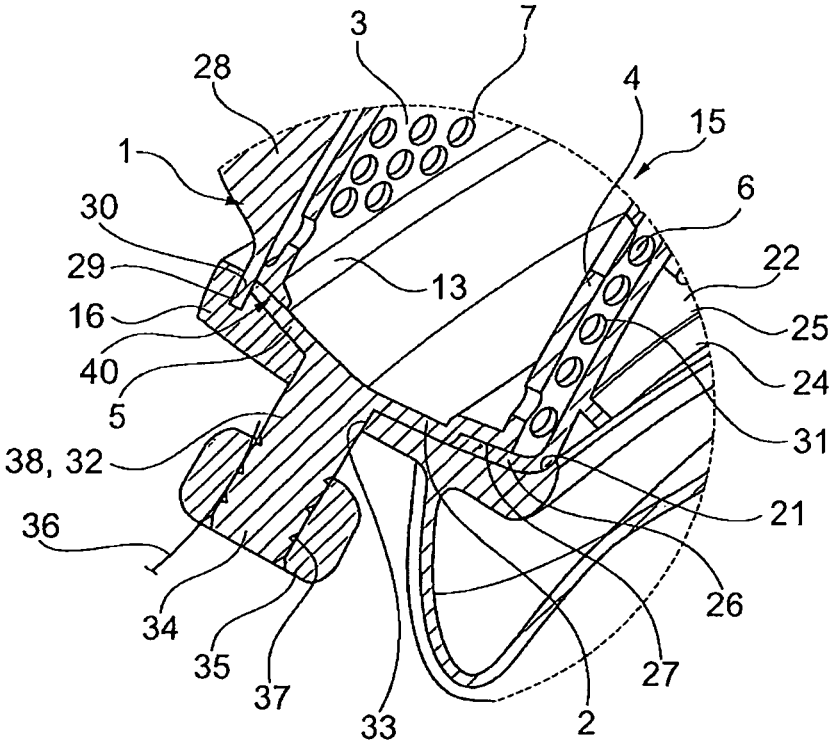
FIG. 4 is an enlarged view of a detail of the filtering face mask of FIG. 3.

In contrast to the first embodiment according to FIGS. 3 and 4 the present embodiment comprises a filter cartridge 1 with a lower filter ring ratio. For this a smaller amount of filter material 14 is provided in the chamber 12 and as such the lid 3 is pushed into the casing 2 further down than in the previous embodiment. Therefore, the distance II between the lid 3 and the bottom 4 according to the present embodiment is smaller than the distance I between the lid 3 and the bottom 4 of the previously described embodiment. As already mentioned with respect to FIG. 1, the free end of the sidewall 5 of the casing 2 of the respective filter cartridge 1 is kept such that the overall dimension of the respective filter cartridge 1 is equal to that of the previous embodiment. Therefore, the same mask 20 body 16 can be used. Due to the advantageous protrusion 13 the lid 3 can be fastened to the sidewall 5 of the casing 2 at any given position by welding the lid 3 or the protrusion 13 to the sidewall 5.

Figure 6:
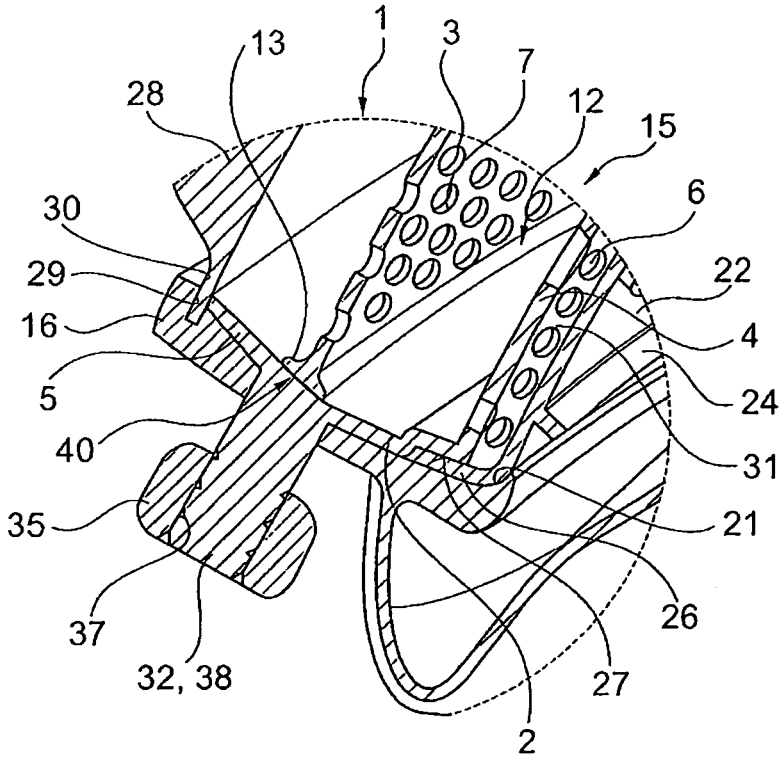
FIG. 6 is an enlarged view of a detail of the filtering face mask of FIG. 5.
Figure 7:
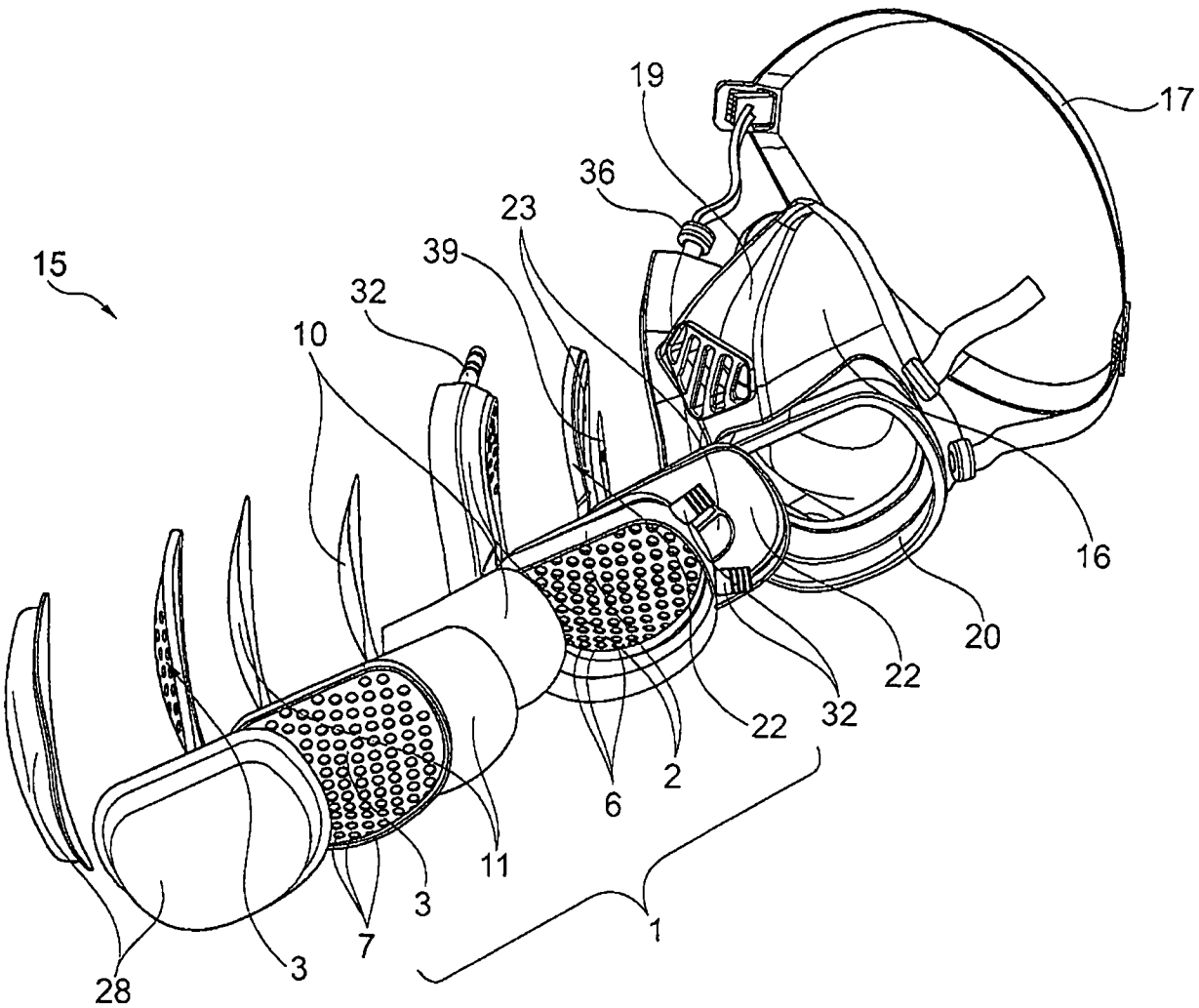
FIG. 7 is an exploded view of the filtering face mask.

FIG. 6 shows an enlarged view of the area B of FIG. 5. While the embodiment of FIG. 3 shows the filtering cartridge 1 in the maximum filled state, FIGS. 5 and 6 show an embodiment with the filtering cartridge 1 containing the lowest amount of compressed filter material possible. Both embodiments make use of the same inventive cartridge 1 providing a curved filter bed. FIG. 7 is an exploded view of the filtering face mask 15 that shows the individual components of the filtering face mask for a better overview.

A valve element 39 is assigned to the opening 23 of the support plate 22. The support plate 22 and the valve element 39 constitute an inhalation-valve that allows air to pass through the opening 23 only if the user inhales such that the air passes from the outside through the filter pad 28, the filter material and the opening 23. The inhalation-valve and the exhalation-valve ensure that during exhalation the air passes through the nose section with a low counter pressure, and that during inhalation the air passes through the filter cartridge 1 such that the user breathes filtered air only.

The material connection between the lid and the casing is preferably designed as weld connection as described above. According to a preferred embodiment the weld connection is realized by pushing a heated or hot needle between the inner side face of the side wall and the outermost side face of the lid 3. Due to the heat the material of the lid 3 and the casing 2 reaches its respective melting point such that the needle can be pushed in easier and at the same time the melted materials of the lid 3 and the casing 2 merge with one another. Once the materials are cooled down a fixed material connection between the lid 3 and the casing 2 is provided. The needle is pushed in only so far that once the needle is removed a circumferential contact area is still in its initial condition such that the lid 3 is closed-fitting to the side wall 5 in said contact area to maintain the tightness of the connection to seal off the filter bed chamber. Preferably the needle is pushed between the lid 3 and the casing 2 as described above at numerous places/points along the circumference of the lid to create a number of welding spots which are particularly evenly distributed.

Figure 8:
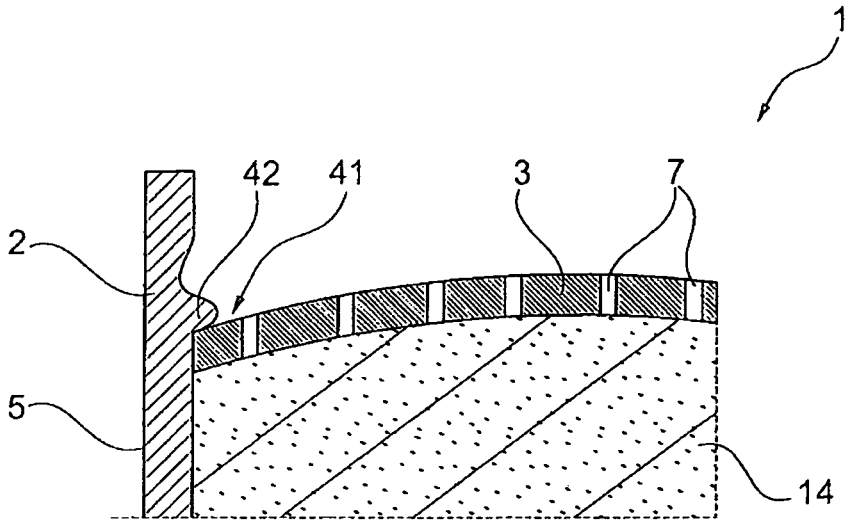
FIG. 8 is an enlarged view of a detail of the filter cartridge according to a further example and FIG. 9 is an enlarged view of a detail of the filtering face mask according to another example.
Figure 9:
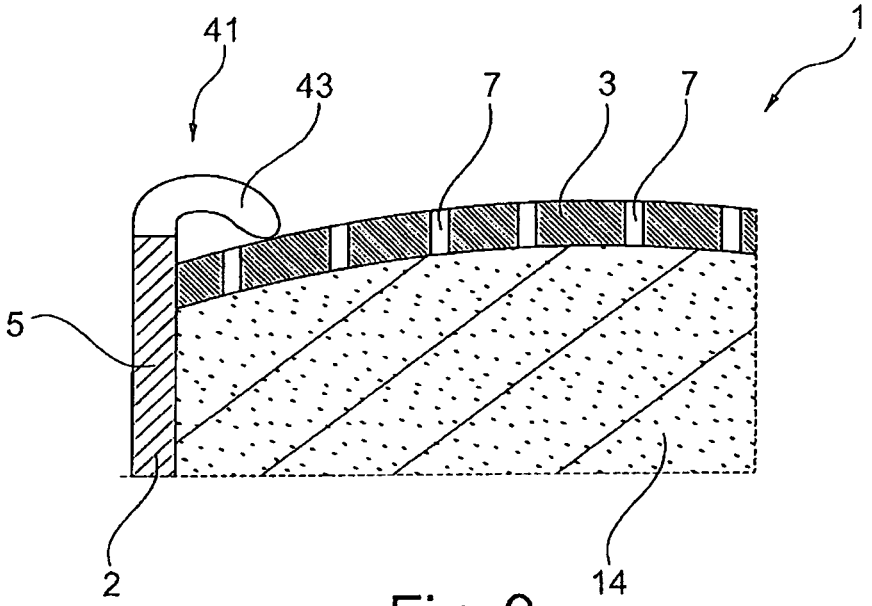

According to an alternative example according to FIGS. 8 and 9, instead of a material connection a form closure is provided that keeps the lid 3 in its place within the casing 2.

The form closure is preferably designed as at least one plastically deformed portion of the casing which protrudes inwards into the casing such that it acts upon the lid 3 in such a way that the filter material compressed between the lid 3 and the casing 2 is kept compressed.

FIG. 8 is an enlarged view of the connection point between the lid 3 and the casing 2 of the filter cartridge 1. According to this example the lid 3 is directly connected to the casing 2 by a form closure 41 which comprises a plastically deformed portion 42 of the casing 2 that is deformed such that it protrudes to the inside of the casing 2 acting upon the lid 3 to maintain the loose filter material 14 compressed between the lid 3 and the casing 2. In this case the deformed portion 42 is a deformed portion of the inner surface of the sidewall 5 of the casing 2. It is produced by a tool that is essentially moved parallel to the sidewall 5 in the axial direction towards the bottom 4 of the casing 2 such that material of the sidewall is pushed and compressed downwards in the direction of the lid, thereby creating a protrusion that reaches inwards.

FIG. 9 is an enlarged view of another example of the form closure 25 41. In this example the plastically deformed portion 42 is a projection 43 that protrudes form the free end of the sidewall 5 and which has (been bent such that it acts up on the lid 3 in the above described manner.

For deforming the sidewall or the projection 43 the casing and/or the respective deforming tool are preferably heated up in particular to 5 prohibit damaging the filter cartridge.

The invention claimed is:

1. Filter cartridge (1) for an air filtering device, in particular for a filtering face mask (15), comprising a stiff cup-shaped casing (2) having a bottom (4) and a circumferential sidewall (5) extending at least section-wise parallel to one axis, a stiff discoidal lid (3) and a filter bed (14) of loose filter material compressed between the lid (3) and the casing (2), the lid (3) and the bottom (4) containing each at least one through-hole (67) so that air to he filtered passes through the filter bed (14), and at least one of the lid (3) and the bottom (4) being curved to at least one direction, whereby the lid (3) is at least essentially arranged within the casing (2), the outermost contour of the lid (3) close-fitting to the inner contour of the Sidewall, (5), and fixed thereto by a direct connection, particularly by a non-detachable connection.

2. Cartridge according to claim 1, characterized in that the lid is fixed to the casing (2) by form closure or material connection (40).

3. Cartridge according to claim 1, characterized in that the material connection (40) that particularly extends along the whole circumference of the lid (3) is a weld 20 connection.

4. Cartridge according to claim 2, characterized in that the form closure comprises at least one plastically deformed portion of at least one of the casing (2) and the lid (3).

5. Cartridge according to claim 1, characterized in that at least one plastically deformed portion of the casing (2) is plastically deformed such that it protrudes to the inside of the casing (2) acting upon the lid (3) to maintain the loose filter material compressed between the lid (3) and the easing (2).

6. Cartridge according to claim 5, characterized in that the plastically deformed portion is a plastically deformed portion of the inner surface of the sidewall (5) or a bent projection that protrudes from a free end of the sidewall (5).

7. Cartridge according to claim 1, characterized in that the lid (3) contains a circumferential protrusion (13) that protrudes essentially parallel to said axis in at least one direction.

8. Cartridge according to claim 7 characterized in that the lid (3) extends parallel to the bottom (4) such that the distance between the lid (3) and the bottom (4) is at least essentially constant and that the filter bed (14) has an at least essentially uniform height.

9. Cartridge according to claim 8, characterized in that the surfaces (8,9) of the lid (3) and the bottom (4) facing each other are each covered by a fleece element (10,11) extending across the at least one respective through hole (6,7).

10. Filtering face mask, in particular compact face mask, comprising a mask body (14) adapted to fit over the nose and mouth of a person and at least one filter cartridge (1) that is arranged in an orifice (20) of the mask body (16), characterized in that the filter cartridge (1) comprising a stiff cup-shaped casing (2) having a bottom (4) and a circumferential sidewall (5) extending at least section-wise parallel to one axis, a stiff discoidal lid (3) and a filter bed (14) of loose filter material compressed between the lid (3) and the casing (2), the lid (3) and the bottom (4) containing each at least one through-hole (6,7) so that air to be filtered passes through the filter bed (14), and at least one of the lid (3) and the bottom (4) being curved to at least one direction, whereby the lid (3) is at least essentially arranged within the casing (2), the outermost contour of the lid (3) close-fitting, to the inner contour of the Sidewalk (5), and fixed thereto by a direct connection, particularly by a non-detachable connection.

11. Filtering face mask according to claim 10, characterized in that the orifice (20) is designed as receptacle (18) in which the cartridge (1) is held with its outer contour of the sidewall in a sealed manner such that air to be filtered passes through the filter bed (14) of the filter cartridge (1) and preferably having at least one abutting shoulder (21) for aligning and supporting the cartridge (1).

12. Filtering face mask according to claim 10, characterized in that between the abutting shoulder (21) and the cartridge (1) a cup-shaped support element (22) comprising at least one opening (23) is arranged essentially spaced apart to the bottom (4).

13. Method for manufacturing a filter cartridge for air filtering 15 devices, in particular for a filtering face mask, comprising the following steps:

providing a stiff cup-shaped casing (2) having a bottom (4) and a circumferential sidewall (5) extending at least section-wise parallel to one axis, the bottom (4) having at least one through-hole (6), pouring out a desired amount of loose filter material into the casing (2) onto its bottom (4), providing a stiff lid (3) with its outermost contour close-fitting to the inside of the sidewall (5) of the casing (2) and having at 25 least one through-hole (7), the lid (3) and/or the bottom (4) are curved into at least one direction, pressing the lid (3) at least essentially into the casing (4) until the filter material is compressed to a uniform filter bed (14) where the filter material is distributed evenly across the cartridge (1), fastening the lid (3) to the casing (2) providing a direct connection, particularly a non-detachable connection between the lid (3) and the casing (2).

14. Method according to claim 13, characterized in that the non-detachable connection is provided by welding the lid (3) at least partially along the circumference of the lid (3) to the sidewall (5) of the casing (2).

15. Method according to claim 13 characterized in that the non-detachable connection is provided by plastically deforming a portion of at least one of the casing and the lid (3).

* * * * *